US012352544B1

(12) United States Patent
Hardy et al.

(10) Patent No.: US 12,352,544 B1
(45) **Date of Patent: *Jul. 8, 2025**

(54) NONFRAGMENTATION MISSILE AND METHOD OF DELIVERING A PAYLOAD THEREWITH

(71) Applicant: Government of the United States, as represented by the Secretary of the Air Force, Wright-Patterson AFB, OH (US)

(72) Inventors: Luke Hardy, Usafa, CO (US); Michael Anderson, Colorado Springs, CO (US); Bradley Bitting, Usafa, CO (US); Trinity Good, Usafa, CO (US); Anthony Neil, Usafa, CO (US); Orval Powell, Colorado Springs, CO (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 63 days.

This patent is subject to a terminal disclaimer.

(21) Appl. No.: 18/498,451

(22) Filed: Oct. 31, 2023

(51) Int. Cl.

| | |
|---|---|
| ***F42B 12/60*** | (2006.01) |
| ***F42B 12/32*** | (2006.01) |
| ***F42B 12/56*** | (2006.01) |
| ***F42B 12/64*** | (2006.01) |
| *F42B 12/20* | (2006.01) |

(52) U.S. Cl.
CPC ..... *F42B 12/56* (2013.01); *F42B 12/32* (2013.01); *F42B 12/60* (2013.01); *F42B 12/64* (2013.01); *F42B 12/20* (2013.01)

(58) Field of Classification Search
CPC ..... F42B 12/56; F42B 12/58; F42B 12/60; F42B 12/64; F42B 12/32
USPC ..... 102/473, 480, 489
See application file for complete search history.

(56) References Cited

U.S. PATENT DOCUMENTS

| | | | | |
|---|---|---|---|---|
| 1,275,660 A * | 8/1918 | Clark | ..... | F42B 12/58 116/106 |
| 1,303,877 A * | 5/1919 | Francois | ..... | F42B 12/58 102/480 |
| 2,428,744 A | 10/1947 | Sonnenschein | | |

(Continued)

OTHER PUBLICATIONS

United States Patent and Trademark Office, Non-Final Office Action mailed Apr. 10, 2025 in U.S. Appl. No. 18/498,427. 12 pages.

(Continued)

*Primary Examiner* — James S Bergin
(74) *Attorney, Agent, or Firm* — AFMCLO/JAZ; Larry L. Huston

(57) ABSTRACT

A missile for delivering a payload and having a longitudinal axis. The missile comprises a nonfragmenation multi-directional munition having a hollow collar. The hollow collar has an inner surface and an outer surface opposed thereto and a first plurality of ports extending therebetween in a substantially radial direction. An ammunition is disposed in each port of the first plurality of ports, oriented outwardly from the longitudinal axis with an ignition source for expelling such ammunition from the collar. The missile also has at least one flight control surface for controlling a trajectory of the missile during flight and a controller for controlling the flight of the missile and the ignition source.

12 Claims, 15 Drawing Sheets

(56) References Cited

U.S. PATENT DOCUMENTS

| | | | | |
|---|---|---|---|---|
| 2,925,965 | A * | 2/1960 | Pierce | F42C 19/095 342/67 |
| 4,172,407 | A * | 10/1979 | Wentink | F42B 12/60 102/480 |
| 4,289,073 | A * | 9/1981 | Romer | F42B 12/60 102/476 |
| 5,691,502 | A | 11/1997 | Craddock et al. | |
| 6,279,482 | B1 * | 8/2001 | Smith | F42B 12/60 102/494 |
| 6,640,723 | B2 | 11/2003 | Spivak et al. | |
| 6,966,265 | B2 | 11/2005 | Ronn et al. | |
| 7,004,075 | B2 | 2/2006 | Ronn et al. | |
| 10,866,072 | B2 | 12/2020 | Imhoff et al. | |
| 11,609,073 | B2 * | 3/2023 | Treadway | F42B 12/60 |
| 2006/0054047 | A1 | 3/2006 | Burri | |
| 2016/0025468 | A1 | 1/2016 | Botthof et al. | |
| 2017/0299358 | A1 | 10/2017 | Miller et al. | |

OTHER PUBLICATIONS

United States Patent and Trademark Office, Non-Final Office Action mailed Mar. 27, 2025 in U.S. Appl. No. 18/498,442. 10 pages.

* cited by examiner

Fig 5A
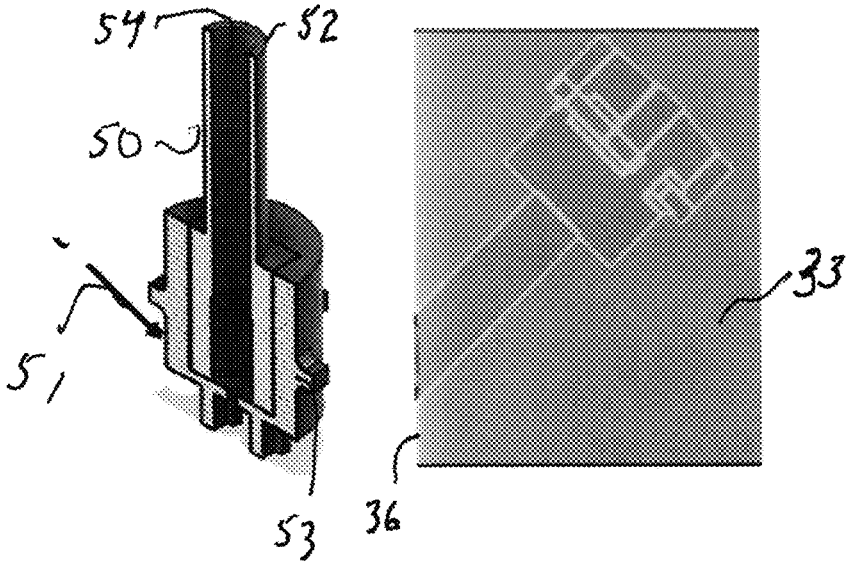
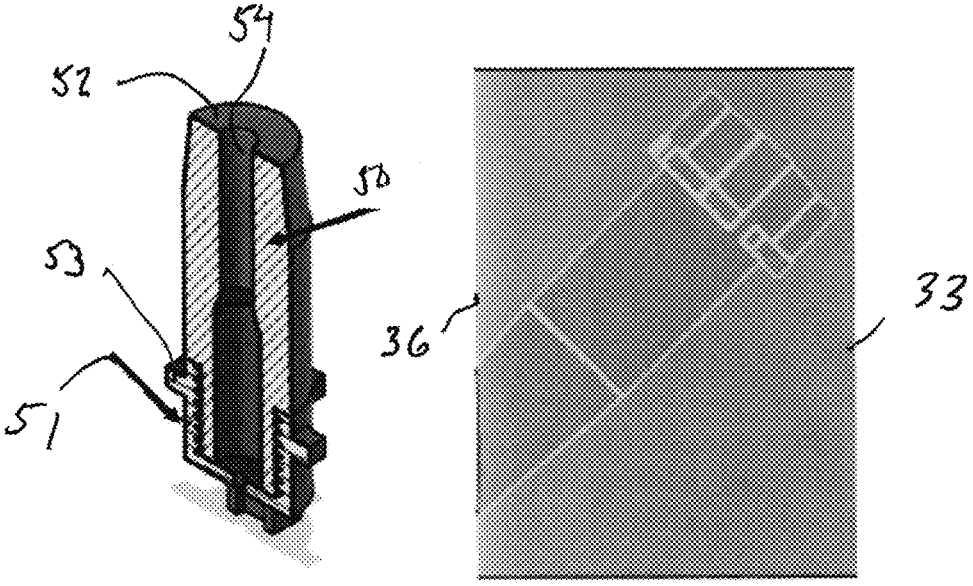
Cross section of barrel and cap
Cut away of barrel and cap inserted in cylinder
Fig 5B Fig 20
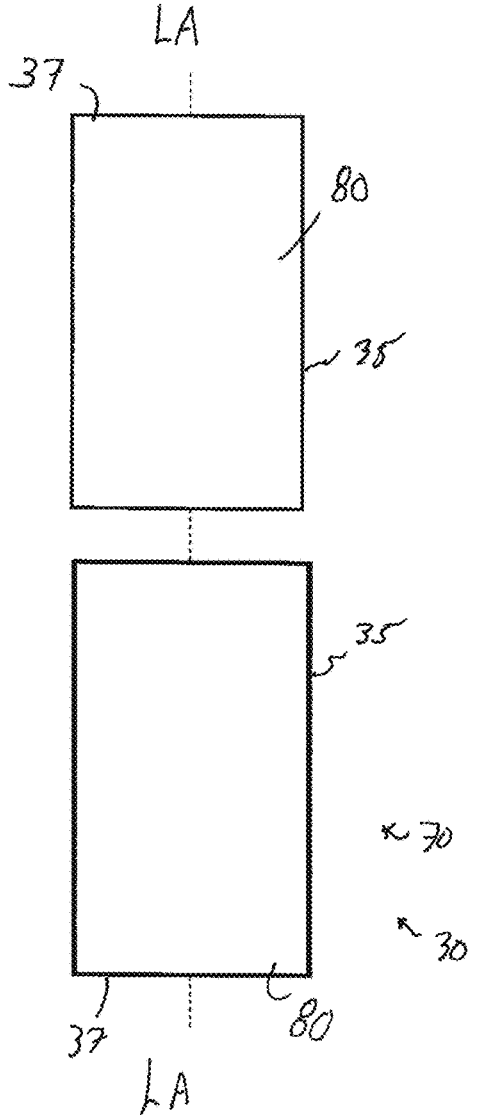
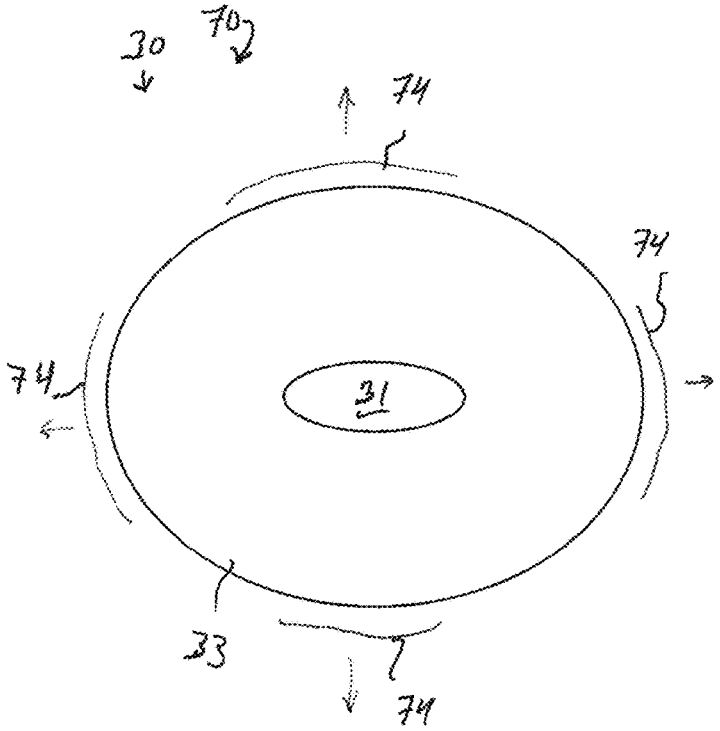
Fig 19

NONFRAGMENTATION MISSILE AND METHOD OF DELIVERING A PAYLOAD THEREWITH

STATEMENT OF GOVERNMENT INTEREST

The invention described and claimed herein may be manufactured, licensed and used by and for the Government of the United States of America for all government purposes without the payment of any royalty.

FIELD OF THE INVENTION

The present invention is related to missiles having nonfragmentation munitions and more particularly to missiles having nonfragmentation munitions with a predetermined radial blast pattern.

BACKGROUND OF THE INVENTION

Fragmentation munitions, such as grenades, have been used for centuries. Today, fragmentation munitions include warheads such as are used for air defense, anti-radiation, and surface killing. Fragmentation munitions work by shattering and blowing the shell of a weapon outwardly under the detonation of an explosive filler.

Fragmentation munitions rely upon kinetic energy to destroy targets under the action of high-energy explosives. Such munitions typically form a large number of high-speed fragments to inflict damage to the intended target. Fragmentation munitions can be grouped as having non-preformed fragments which burst into shards or splinters and preformed fragments of various shapes (spheres, cubes, rods, etc.) and sizes. Both types of fragments are typically rigidly contained within a matrix or body until a high explosive (HE) filling is detonated. The resulting high-velocity fragments produced by either type of munition are the main lethal mechanisms of these weapons, rather than heat or overpressure caused by the detonation.

Fragmentation warheads can be divided into three types: natural, pre-controlled, and prefabricated fragment warheads. The fragments of natural fragment warheads are formed by the expansion and fracture of the shell under the action of detonation products. The characteristics of this type of warhead are that the shell acts as both a container and a killing element, and the utilization of materials is high. The pre-controlled fragment warhead adopts technical measures such as shell notching, explosive notching or adding inner lining to weaken the local strength of the shell and control the ruptured part of the explosion to form a fragment. The prefabricated fragment warheads are pre-formed and embedded in the shell matrix material or bonded to the thin skin surrounding the explosive.

But each of these fragmentation grenades, warheads and other devices suffer from the disadvantage of being limited in the directionality and timing of the detonations. Detonation fragments may blast equally in all directions, wasting munitions which are not directed towards the target. Furthermore, collateral and unintended damage may occur.

The present invention is directed to overcoming the problems of fragmentation munitions by providing a nonfragmentation munition. The present invention is further directed to the problem of controlled detonation of nonfragmentation munitions in both the radial directions and the longitudinal direction perpendicular thereto.

SUMMARY OF THE INVENTION

In one embodiment the invention comprises a missile for delivering a payload and defining a longitudinal axis. The missile comprises a nonfragmenation multi-directional munition having a hollow collar. The hollow collar has an inner surface and an outer surface opposed thereto and a first plurality of ports extending therebetween in a substantially radial direction. A first plurality of ammunitions is provided, wherein an ammunition is disposed in each port of the first plurality of ports and oriented outwardly from the longitudinal axis with an ignition source for expelling each ammunition of the first plurality of ammunitions outwardly from the collar. The missile also has at least one flight control surface for controlling a trajectory of the missile during flight; and a controller for controlling the flight of the missile and the ignition source.

BRIEF DESCRIPTION OF THE DRAWING

All drawings are to scale except the drawings, or a limited portion thereof, specifically designated below as schematic.

FIG. 5A is a sectional view of a barrel and cap usable with the present invention and fragmentary sectional view of a collar therefor.

FIG. 5B is a sectional view of an alternative barrel and cap usable with the present invention and fragmentary sectional view of a collar therefor.

FIG. 19 is an exploded schematic top sectional view of a missile according to the present invention having removable covers.

FIG. 20 is a schematic side elevational view of a plural phase munition according to the present invention having plural collars.

DETAILED DESCRIPTION OF THE INVENTION

Figure 1:
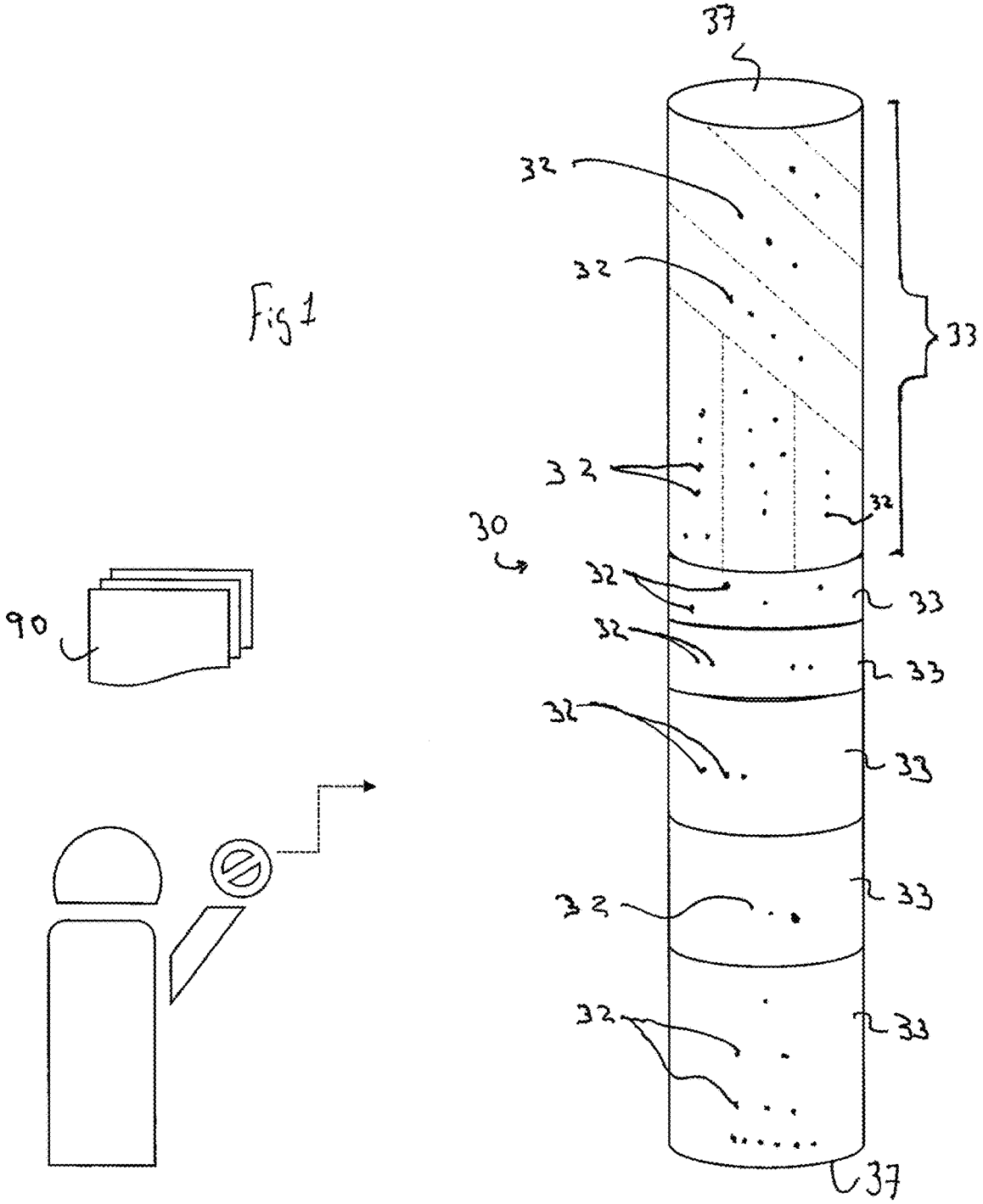
FIG. 1 is a schematic side elevational view of an operator and munition usable as a payload according to the present invention.
Figure 2A:
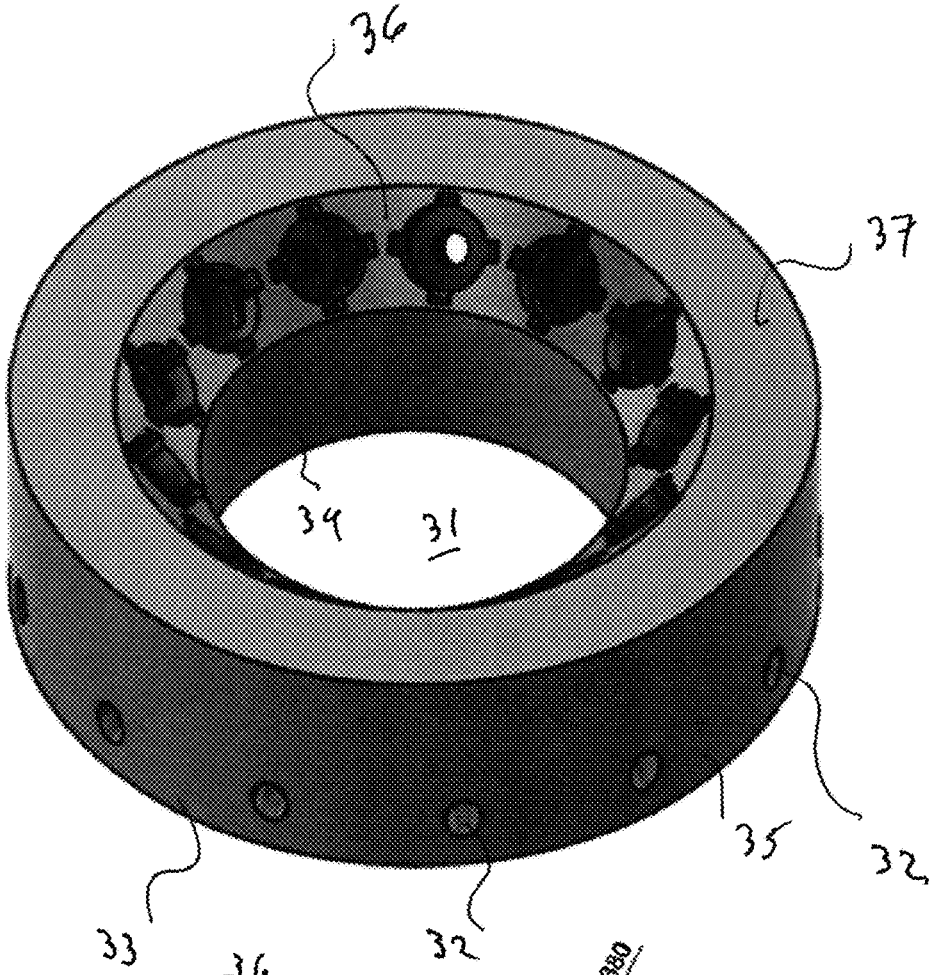
FIG. 2A is a first perspective view of a collar according to the present invention.
Figure 2C:
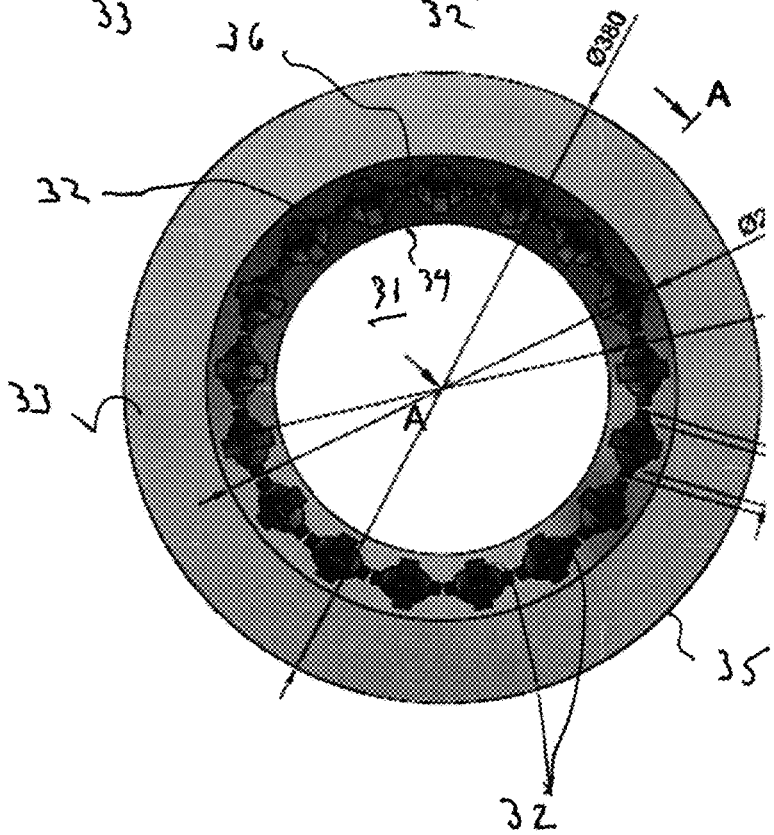
FIG. 2C is a third perspective view of the collar of FIGS. 2A and 2B.

Referring to FIG. 1, in one aspect the invention comprises a multidirectional munition 30. The munition 30 may be used as a standalone device, as shown and/or may preferably be deployed in a missile 70 as described below. The munition 30 is placed near a target of interest and detonated by an operator in known fashion. Detonation may be performed wireless, wired, responsive to a preset detonation time occurring, responsive to a detonation signal from an operator, responsive to a change in elevation, responsive to a change in or attaining a certain velocity, etc.

Particularly, the munition 30 is a nonfragmenation munition 30. By nonfragmenation, it is meant that the munition 30 does not rupture or plastically deform the shell during detonation and firing of ammunition 40 contained therein.

Referring to FIG. 2A, FIG. 2B, FIG. 2C and FIG. 2D and examining the invention in more detail, the munition 30 comprises at least one nonfragmenation hollow collar 33 having a plurality of ports 32 therethrough. The nonfragmenation collar 33 is bounded by an inner surface 34 defining a core 31 which can accept additional components as described herein and bounded by an outer surface 35 radially opposed to the inner surface 34. In a nonfragmentation munition 30 such as described and claimed herein a nonfragmenation collar 33 does not rupture or plastically deform during detonation and firing of ammunition 40 contained therein. Instead, ammunition 40 is inserted into the core 31 of the collar 33 as described below and fired outwardly from the collar.

The collar 33 may be round, as shown and may be eccentric or preferably concentric relative to a longitudinal axis which is generally perpendicular to the plane of the collar. The collar 33 may be aluminum, such as T-6061 Aluminum or plastic, such as ABS plastic. The ports 32 may be sleeved with tool steel, such as H13 tool steel. Alternatively, the collar 33 may be made of steel, such as tool steel.

The plurality of ports 32 may circumscribe the collar 33 or may be concentrated towards one side of the collar. The ports 32 extend between the core 31 of the collar 33 and in a vector component radially outward of the collar 33 towards the external environment. In a degenerate case, the ports 32 are identically radially oriented and are perpendicular to the longitudinal axis. The ports 32 may be equally or unequally sized and spaced apart in the circumferential direction. The ports 32 may lie on a common circumference or may be spaced apart in the longitudinal direction.

In a nonlimiting exemplary embodiment, an aluminum collar 33 may be circular with an OD at the outer surface 35 of 380 mm, an inner diameter at the inner surface 34 of 280 mm, a radial thickness of 50 mm and a slanted annulus 36 with a maximum diameter of 280 mm. The slanted annulus 36 is a flat face oriented 45 degrees to the longitudinal axis. The collar 33 has a longitudinal dimension of 120 mm between first and second opposed ends 37 which may be mutually parallel and may be perpendicular to the longitudinal axis LA. The collar 33 has 20 equally spaced ports 32, each with a diameter of 41 mm, radially oriented relative to the outer surface 35 and oriented 45 degrees relative to the longitudinal axis. The ports 32 may be oriented in the same longitudinal direction or opposed longitudinal directions. A single collar 33 munition 30 may have an aspect ratio taken between longitudinally opposed ends 37 and the outer surface 35 ranging from 2.5 to 4.5.

The ports 32 may be round as shown, or may have any other suitable shape or shapes. The ports 32 may be sized for specific ammunition 40 to be expelled through the ports 32 in a generally radial direction. Ammunition 40 suitable for use with the collar 33 of the present invention includes individual bullets 41, explosives 42 and combinations thereof.

Figure 3A:
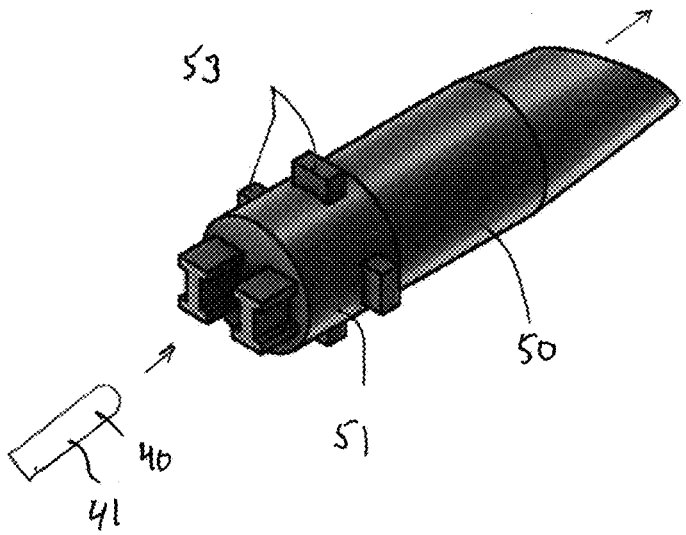
FIG. 3A is a perspective view of a collar and cap according to the present invention having a schematic bullet.
Figure 3B:
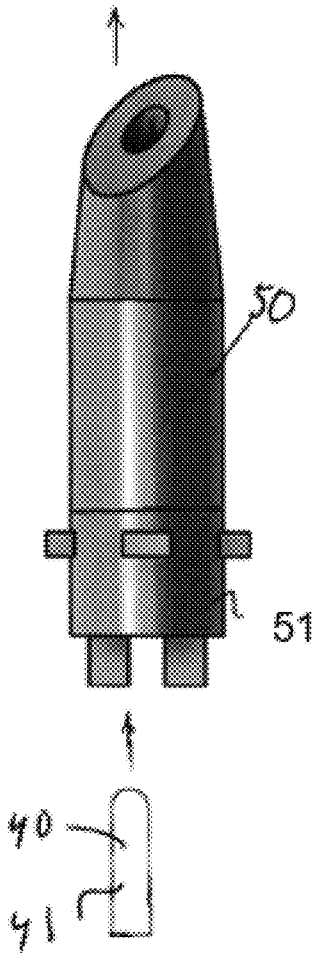
FIG. 3B is a side elevational view of the collar, cap and schematic bullet of FIG. 3A.

Referring to FIG. 3A and FIG. 3B, suitable exemplary bullets 41 for the ammunition 40 include, without limitation, 5.56×45 mm NATO bullets 41, .308 caliber bullets 41, .45 caliber bullets 41 and preferably electrically primed 20 mm×102 PGU Ammunition PGU-27A/B-PGU-28A/B-PGU-30A/B (gd-ots.com) available from General Dynamics Corporation of Reston, VA. The munition 30 may use bullets 41 of equal or unequal sizes, calibers and ignition sources 43. For example, in a nonlimiting embodiment the collar 33 may have an even number of ports 32 circumscribing the core 31 and the ports 32 alternatingly have bullets 41 of relatively larger and relatively smaller calibers. This arrangement provides the benefit that larger caliber bullets 41 may be interposed between adjacent smaller bullets 41 for effect while the smaller caliber bullets 41 conserve weight and cost without unduly sacrificing effect.

The bullets 41 may be simultaneously fired or sequentially fired, as disclosed below. Each bullet 41 may be connected to the controller 45 by a dedicated wire 46. The bullets 41 are fired outwardly, in a direction away from the longitudinal axis LA and with a radial vector component. The bullets 41 may be fired perpendicular to the longitudinal axis in a degenerate case. Or the bullets 41 may be fired in a direction having a vector component parallel to the longitudinal axis LA.

Each bullet 41 may be held in a respective barrel 50 and cap 51 assembly having a bore 54 therethrough. The barrel 50 positions the bullet 41 for firing outwardly from the core 31 in a prescribed and predetermined direction. The barrels 50 may be individually loaded with the bullets 41 as accessed from the core 31 of the collar. The barrel 50 and core 31 may be integral or preferably are separable as shown. The cap 51 rigidly positions the in the collar 33 for transport to the site of interest in the hostile environment and subsequent firing from the munition 30. The cap 51 removably attach to the inner surface 34 of the collar 33 through bayonet fittings 53, as shown, threaded fasteners, etc.

Figure 4A:
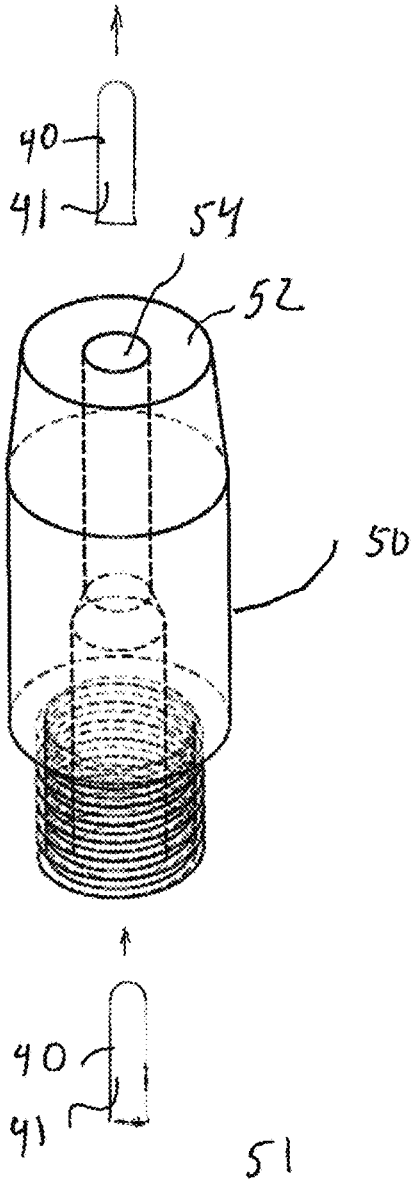
FIG. 4A is an exploded phantom perspective view of a barrel and cap usable with the collar of the present invention.
Figure 4B:
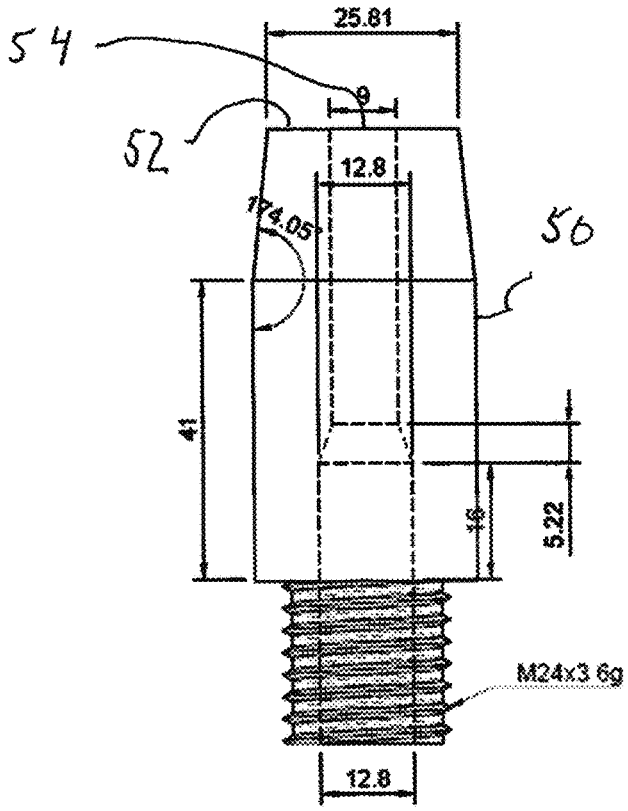
FIG. 4B is a phantom side elevational view of the barrel of FIG. 4A.
Figure 4C:
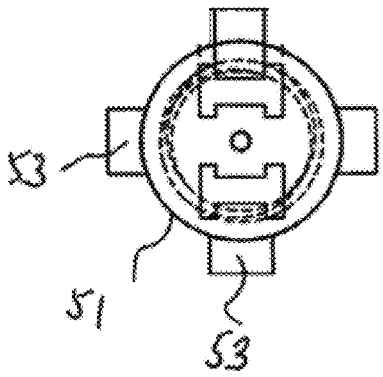
FIG. 4C is a phantom bottom view of the cap of FIG. 4A.

Referring to FIG. 4A, FIG. 4B and FIG. 4C, the barrel 50 and cap 51 may be separated and a bullet 41 inserted into the barrel 50 and oriented towards the distal end 52 of the bore 54. Upon insertion of the bullet, the barrel 50 and cap 51 are separably re-assembled for use.

Referring to FIG. 5A and FIG. 5B, the barrel 50 and cap 51 may be held together using a friction fit or screw threads, respectively. Upon attachment of the cap 51 to the barrel 50, with a bullet 41 inserted therein, the cap 51 and barrel 50 assembly may be inserted into a respective port 32 of the collar. The bullet 41 is then fired from the munition 30 upon command from an operator or other signal to the ignition source 43. The operator may load instructions 90 for the munition 30 to deploy the bullets 41 at a predetermined time, altitude, upon command, etc.

Upon firing the collar/munition may be discarded or reused. If the collar 33 is to be reused, the cap 51, with barrel 50 attached, may be removed from the collar. Upon removal, the cap 51 and barrel 50 are separated and restored as necessary. The barrel 50 may then be reloaded with a new bullet. The cap 51 and barrel 50 are reassembled and inserted into a respective port 32 for reuse.

Figure 6:
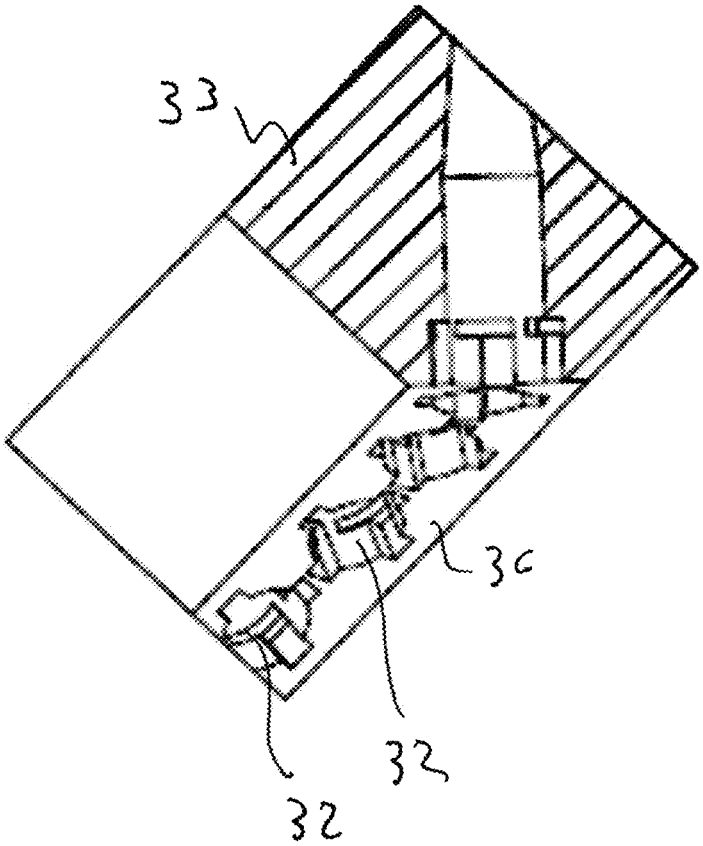
FIG. 6 is a sectional view taken along line A-A of FIG. 2C.

Referring to FIG. 6, the collar 33 may further comprise a slanted annulus 36 as part of or contiguous with the inner surface 34. The slanted annulus 36 provides a surface for the port 32 which may be non-perpendicular to the longitudinal axis. The slanted annulus 36 may be disposed 35 degrees to 60 degrees, particularly about 45 degrees from the longitudinal axis in either direction. The distal end 52 of the barrel 50 may be sloped as needed to be flush with the outer surface 35.

Figure 7:
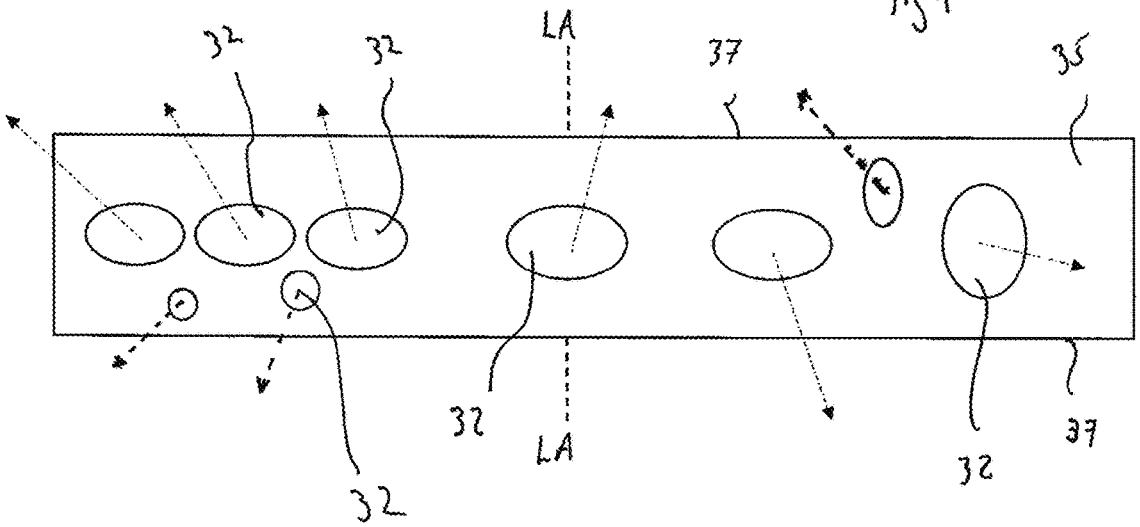
FIG. 7 is a side elevational view of an alternative collar according to the present invention.

Referring to FIG. 7, the ports 32 of the collar 33 may be equally or unequally spaced in the longitudinal and/or circumferential directions, equally or unequally sized and/or shaped, and have common and/or different orientations. This arrangement provides the flexibility for different ammunitions 40 to be used with the same munition 30 as judged helpful for a particular mission.

Figure 8:
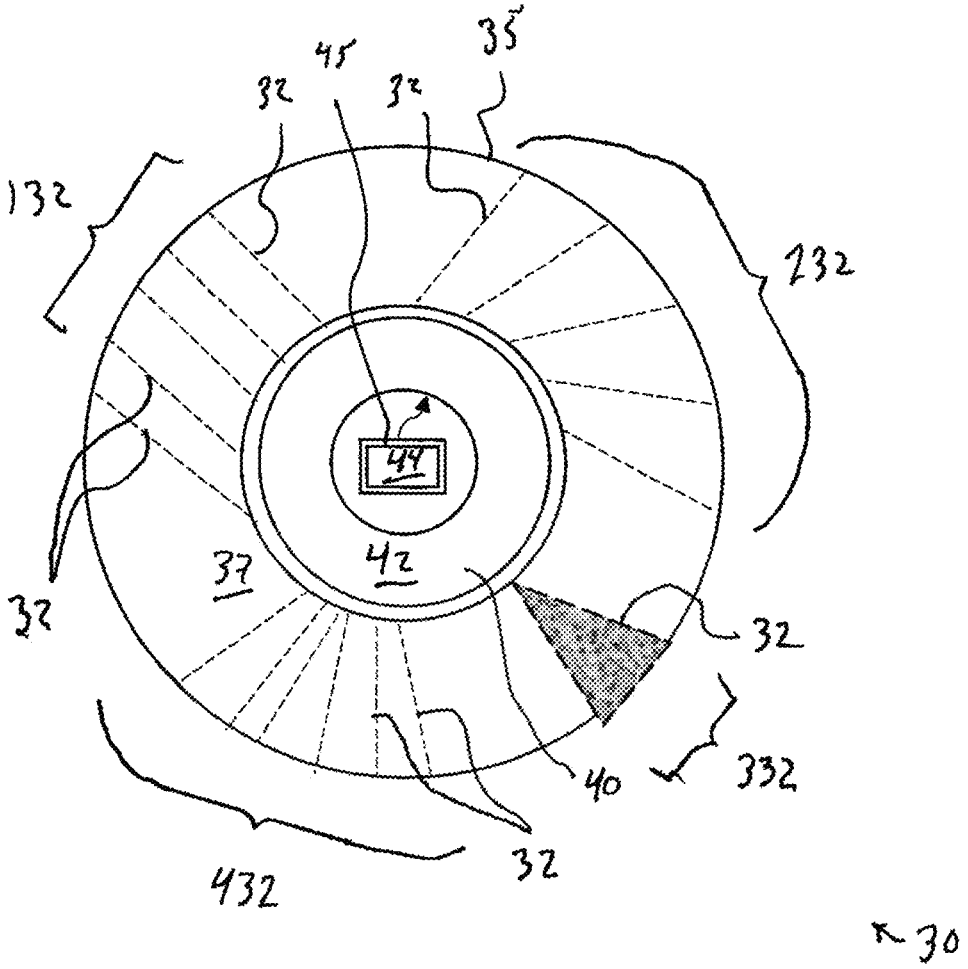
FIG. 8 is a schematic azimuthal top plan view of an alternative embodiment of a collar having a quadrant with parallel ports, a quadrant with ports skewed relative to the radial direction, a quadrant with a tapered port and a quadrant with mutually divergent ports.

Referring to FIG. 8, the munition 30 may further comprise an ignition source 43 for igniting the ammunition 40 and initiating the firing process. The ignition source 43 may comprise a battery 44 and a controller 45 for direct ignition or to detent a firing pin. The controller 45 may detonate to ammunition 40 based upon time after drop from an aircraft, altitude, etc.

In an alternative embodiment, the ignition source 43 may be a high pressure fluid source. The fluid may be air, nitrogen, water, etc. The high pressure fluid system provides the benefit that all of the ammunition 40 is simultaneously fired in an axisymmetric collar.

With continuing reference to FIG. 8, the ports 32 may be arranged in one or more clusters 132, 232, 332, 432 having radial vector components and vector components which provide additional functionality. For example, a first cluster 132 may have ports 32 which are mutually parallel. This cluster 132 provides the benefit that multiple rounds of ammunition 40 may be fired towards the same target. A second cluster 232 of ports 32 may be spirally arranged relative to the longitudinal axis. This cluster 232 provides the benefit that shots may be oriented towards a particular target even if the azimuth of the munition 30 is oriented elsewhere. A third cluster of the port 32 or ports 32 may provide for divergence from a common point. This cluster 332 provides the benefit that an explosive 42 may be advantageously used and intercept a relatively larger area of the target that would occur with ports 32 of constant cross section. A fourth cluster 432 may provide for individually divergent ports 32 from different positions within the core 31. This cluster 432 provides the benefit that the ports 32 may be tailored for maximum impact at a particular target.

Figure 9:
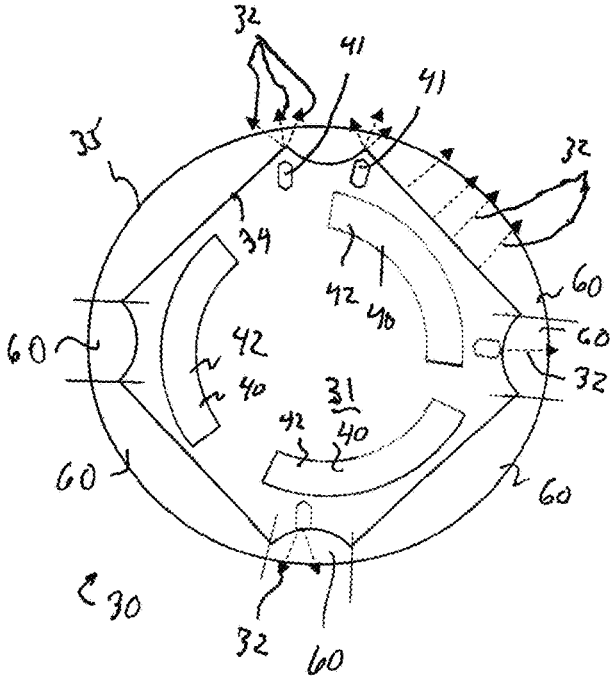
FIG. 9 is a top plan view of an alternative embodiment of a collar according to the present invention having an irregular inner surface.

Referring to FIG. 9, the collar 33 of the munition 30 may have a variable cross section, providing differential radial thickness of the collar 33 as taken perpendicular to the longitudinal axis. The variable cross section occurs due to differential radial dimensions of the outer surface 35, inner surface 34 as shown, or both. This arrangement provides the benefit that bullets 41 may be readily aimed in different directions as shown by the arrows. Or if an explosive 42 ammunition 40 is used, the thinner sections of the collar 33 may be frangible, providing a fragmentation munition 30 with a plurality of fragments 60. The munition 30 may have a singular explosive, or plural explosives 42 which are equally or unequally sized.

Figure 10:
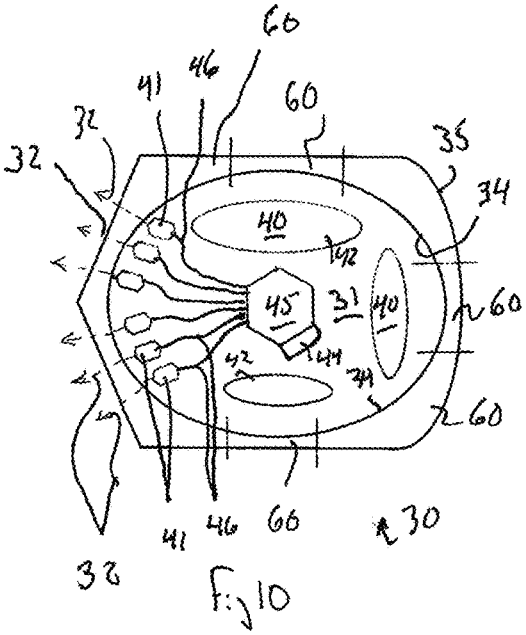
FIG. 10 is a top plan view of an alternative embodiment of a collar according to the present invention having an irregular outer surface.

Referring to FIG. 10, the collar 33 may be provided with a variable radius of the outer surface 35. This arrangement provides the benefit that, again, bullets 41 selected for ammunition 40 may be oriented in particular directions as shown by the arrows and judged helpful for a particular target. The munition 30 is eccentric relative to the longitudinal axis. Again, if an explosive 42 ammunition 40 is used, the thinner sections of the collar 33 may be frangible, exploding into a plurality of fragments 60. Again, the munition 30 may have a singular explosive, or plural explosives 42 which are equally or unequally sized.

Figure 11A:
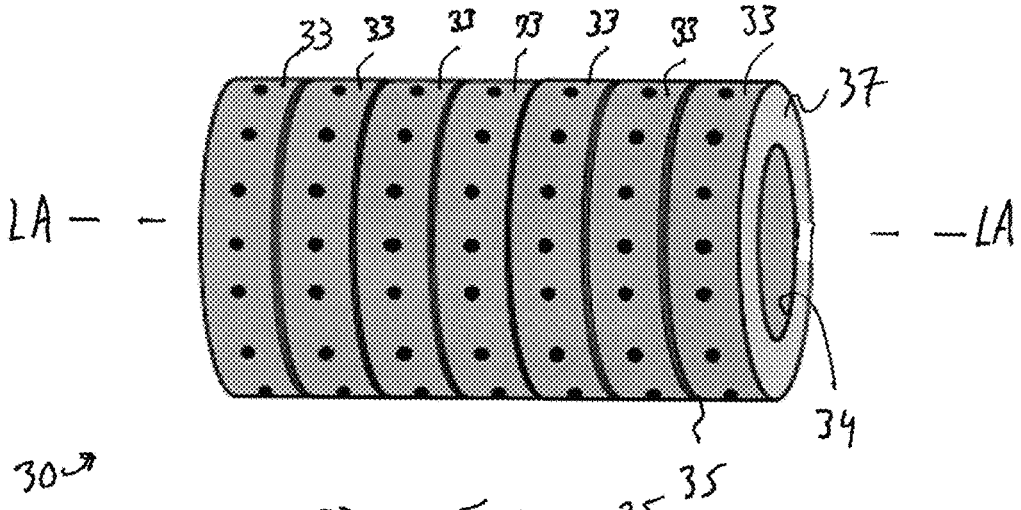
FIG. 11A is a perspective view of longitudinally stacked collars in one aspect of the present invention.

Referring to FIG. 11A, a longitudinally elongate munition 30 may comprise a plurality of collars 33 longitudinally stacked together. This arrangement provides the benefit that a larger munition 30 may be provided and further provided with differential effects, as dictated by the properties of the individual collars. This arrangement further provides the benefit that the munition 30 may have a modular construction. The elongate munition 30 may have a nonconductive film between adjacent stacked collars 33, to prevent premature ignition of staged collars 33. The collars 33 may be joined by adhesive, welding or structural connections.

A first mission may comprise a plurality of identical collars, with the number of collars 33 determined by the size of the desired effect. A second mission may comprise fewer or more collars 33 as needed for the desired effect. A third mission may require a munition 30 comprising a plurality of different collars 33 providing different effects as needed for the mission. Yet a fourth mission may require a munition 30 comprising a different plurality of non-identical collars 33 providing alternative different effects as needed for that mission.

As noted above, the collars 33 may be identical or different as needed for the particular mission. A particular collar 33 may have ports 32 which are identical or different. This modular construction provides flexibility and options not available with the known prior art. Such a munition 30 may comprise from 2 to 20 collars 33 and preferably 6 to 10 collars, each concentric about the longitudinal axis. A munition 30 having longitudinally stacked collars 33 may have an aspect ratio taken as the ratio between longitudinally opposed and the diameter of the outer surface 35 from 1.5 to 10.

Figure 11B:
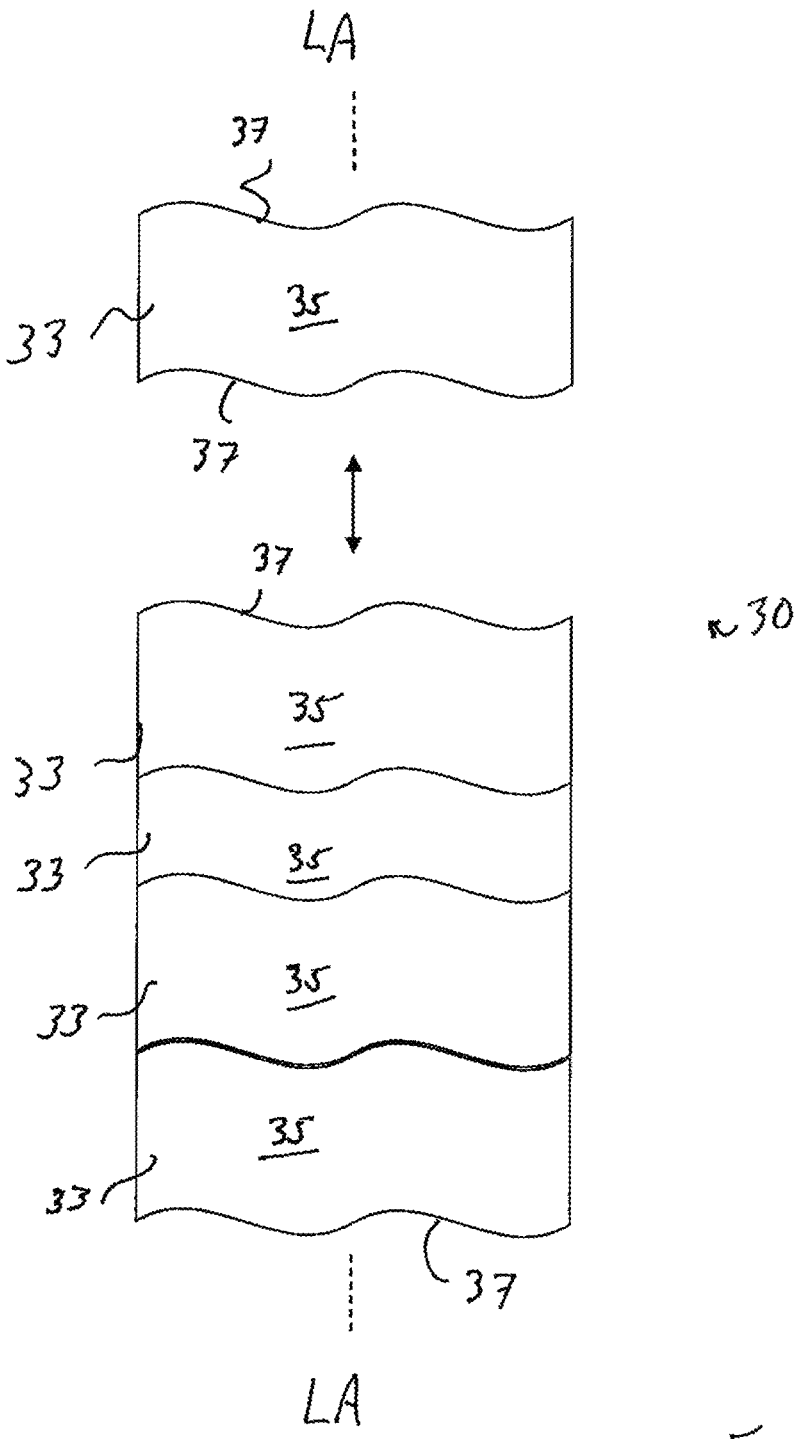
FIG. 11B is a side elevational view of crenulated longitudinally stacked collars having the ports omitted for clarity.

Referring to FIG. 11B, longitudinally stacked collars 33 may have crenulated ends. This arrangement provides the benefit that one collar 33 will not rotate relative to adjacent collars 33 and more ports 32 may be longitudinally disposed on the same collar.

Figure 12:
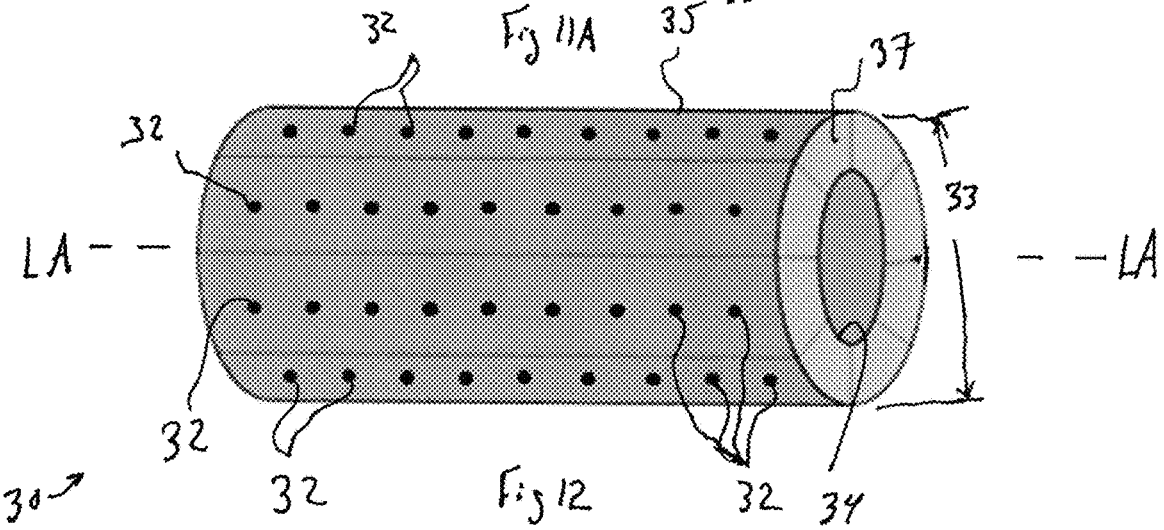
FIG. 12 is a perspective view of a circumferentially segmented collar in one aspect of the present invention.

Referring to FIG. 12, a longitudinally elongate munition 30 may be provided by joining elongate circumferentially adjacent sectors 160 together. This arrangement provides the benefit that different sectors 160, 260 may be used for different circumferential positions.

Figure 13:
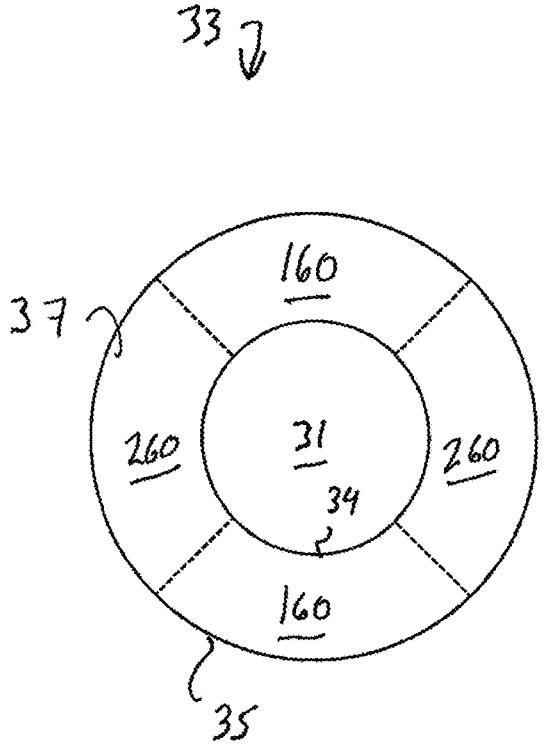
FIG. 13 is a top plan view of a collar divided into two pairs of quadrants.

Referring to FIG. 13, for example if four sectors 160, 260 are used, two opposed sectors 160 may have greater effect and two alternatingly adjacent and opposed sectors 260 may have lesser effect. For example, two opposed sectors 160 may have relatively larger ports 32 through which relatively larger ammunition 40 may be expelled upon ignition and two opposed sectors 260 may have relatively smaller ports 32 through which relatively smaller ammunition 40 may be expelled upon ignition.

Figure 14:
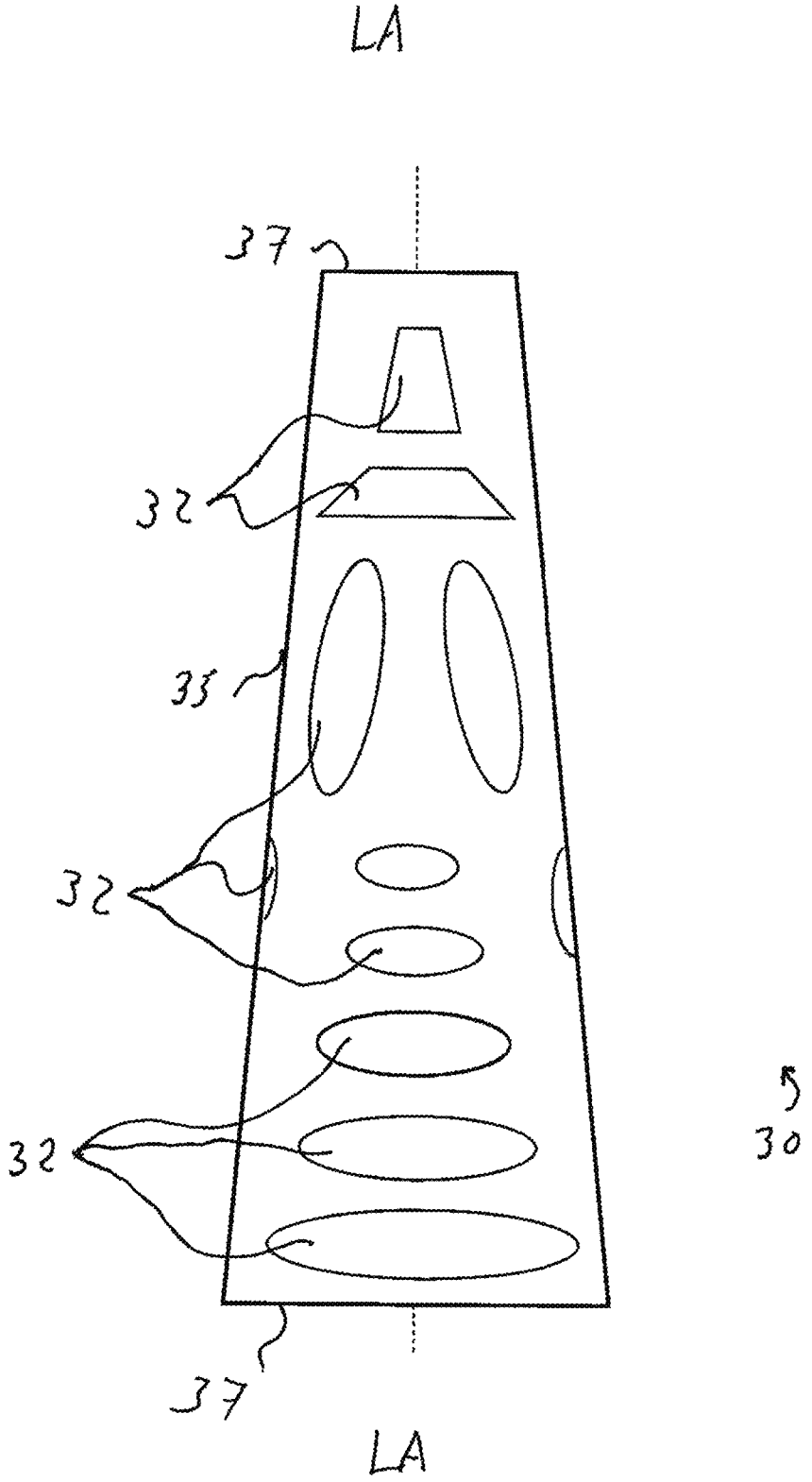
FIG. 14 is a side elevational view of an elongate monolithic collar according to the present invention having mutually different port geometries.

Referring to FIG. 14, the munition 30 may be monotonically tapered. This arrangement provides the benefit that different sizes and shapes of ports 32 may be tailored to the circumference of the collar 33 at any particular longitudinal position. In a degenerate case the circumference is round.

Figure 15:
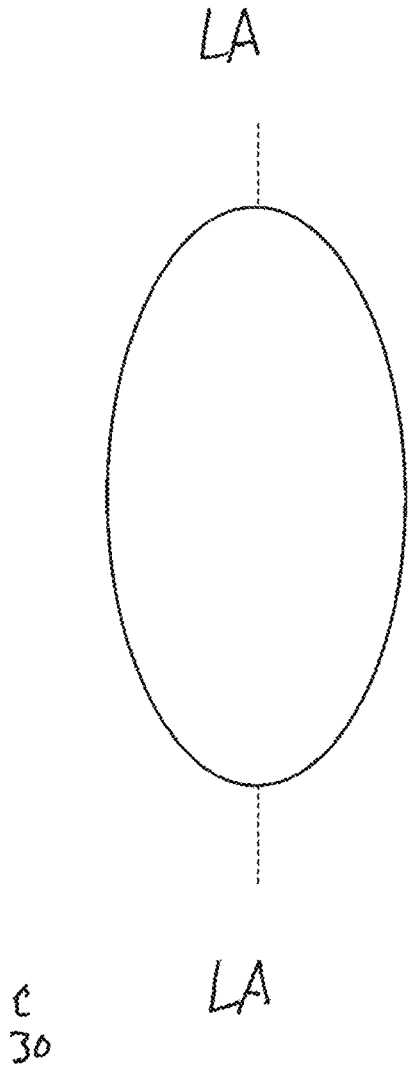
FIG. 15 is a schematic side elevational view of a barrel shaped munition.

Referring to FIG. 15, in an alternative embodiment the munition 30 may be barrel shaped. This geometry provides the benefit that as the longitudinally opposed ends 37 are approached, the ammunition 40 takes on a more longitudinal vector. If desired the density of substantially equally sized ports 32 may increase as the ends 37 are approached. This arrangement provides the benefit that ammunition 40 can be conserved near the longitudinal center due to being intermediate two zones of higher density ammunition 40.

Figure 16:
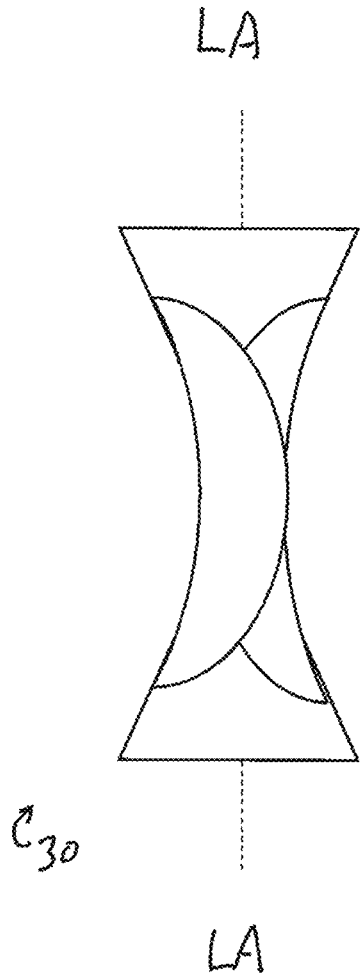
FIG. 16 is a schematic side elevational view of an hourglass shaped munition.

Referring to FIG. 16, in an alternative embodiment, the munition 30 may be hourglass shaped and particularly be hyperbolically shaped. This geometry provides the benefit that target zones near the longitudinal center of the munition 30 receive ammunition 40 from two longitudinally opposed directions.

One of skill will recognize any of the embodiment of FIGS. 14-16 will advantageously have ammunition 40 which fires with both radial and longitudinal vector orientations. Furthermore the ports 32 may be tailored to provide relatively equalized or specifically biased effect upon firing.

Figure 17:
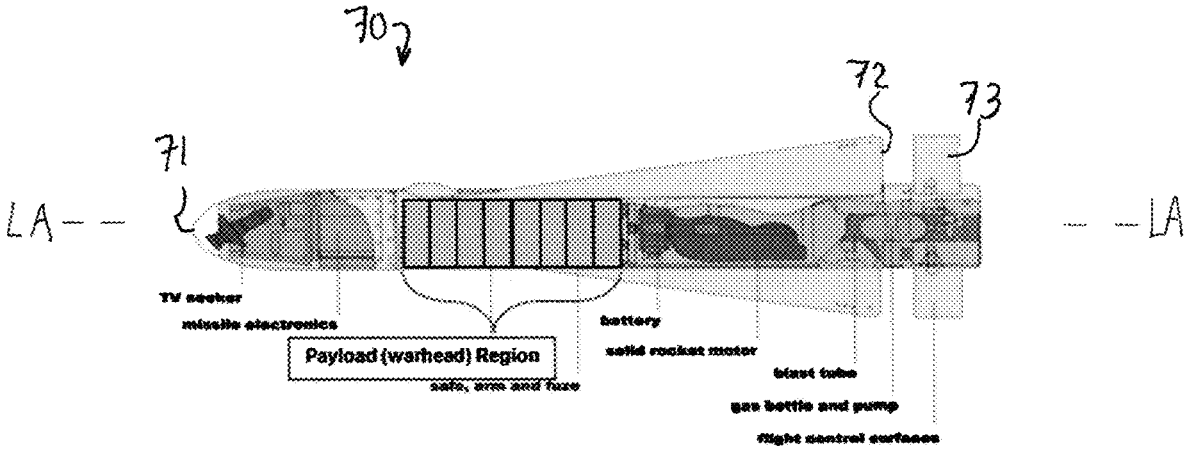
FIG. 17 is a side elevational phantom view of a missile according to the present invention.
Figure 2B:
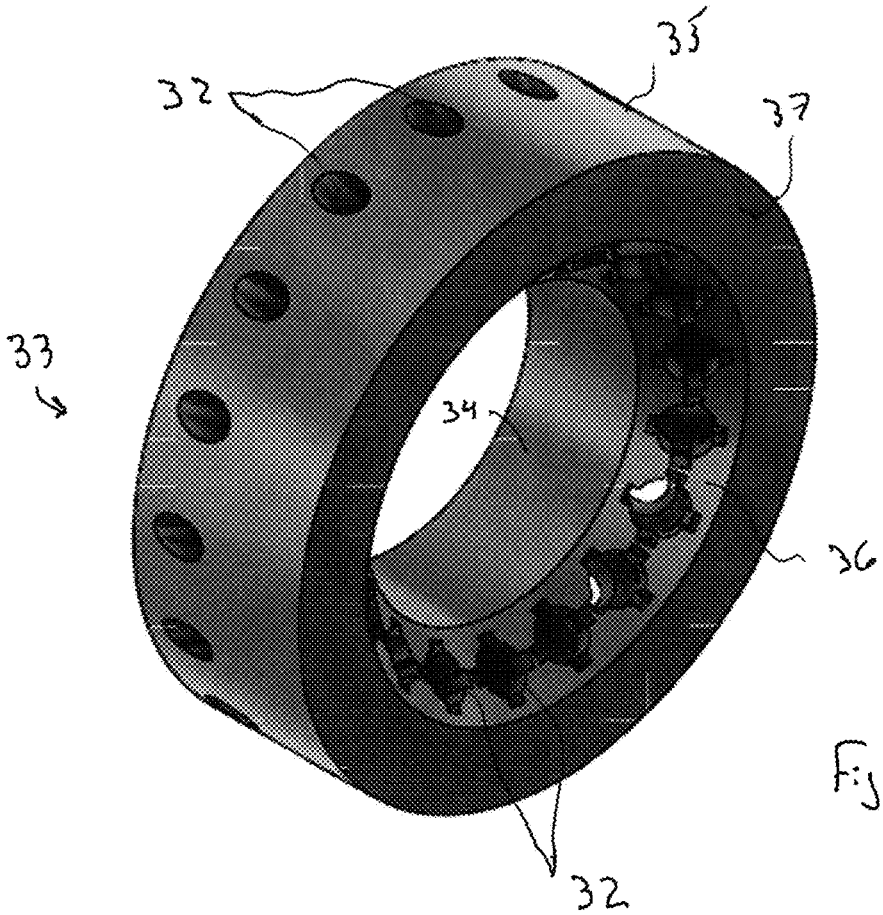
FIG. 2B is a second perspective view of the collar of FIG. 2A.
Figure 2D:
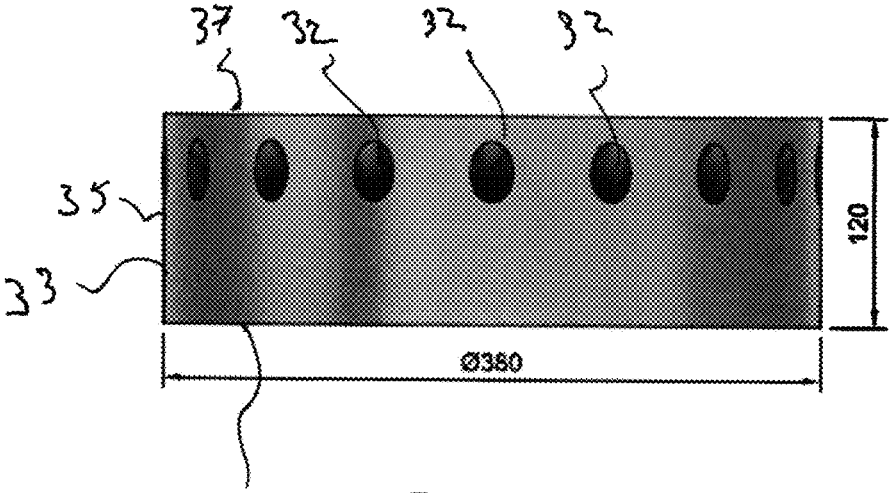
FIG. 2D is a side elevational view of the collar of FIGS. 2A, 2B and 2C.

Referring to FIG. 17, the munition 30 may be delivered by a missile 70 as the payload 76 thereof. The missile 70 may have a nose 71 and longitudinally opposed tail 72 with optional control surfaces 73. The missile 70 may have a battery 44 which powers the missile 70 controller 45 and the ignition source 43 or the ignition source 43 may have a dedicated battery 44. The missile 70 may have a rocket motor which operates in known fashion, one or more covers 74 which provide for aerodynamic efficiency. The munition 30 may comprise a single collar 33 or longitudinally stacked collars, as shown.

Figure 18:
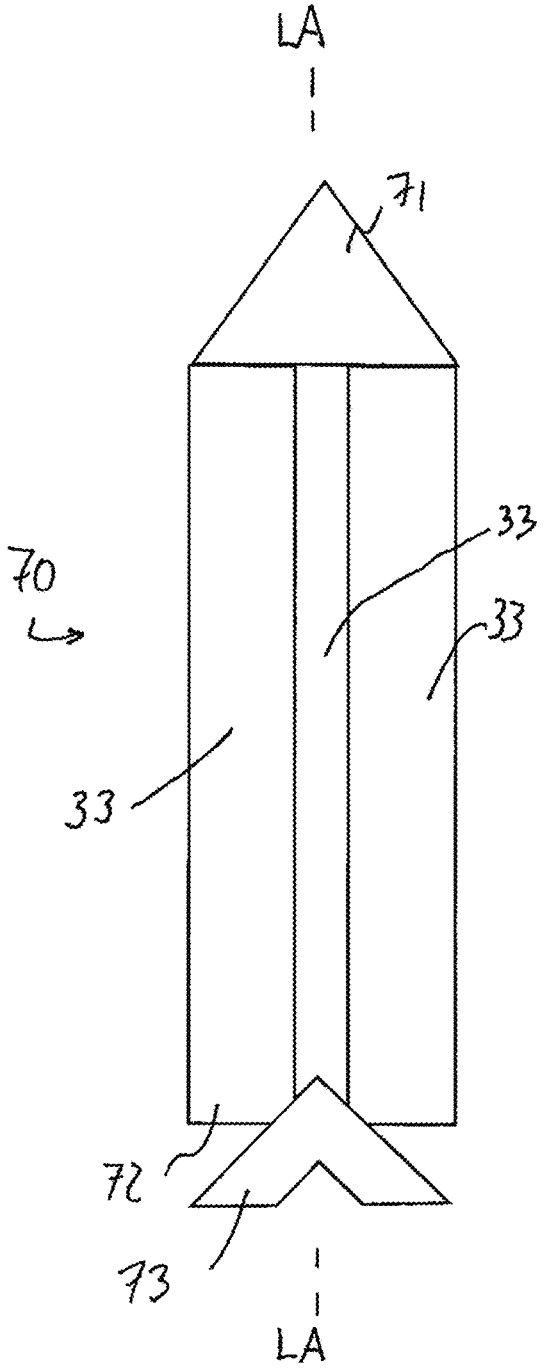
FIG. 18 is a schematic side elevational view of a longitudinally segmented missile according to the present invention.

Referring to FIG. 18, the missile 70 may have a payload 76 which comprises longitudinally elongate adjacent sectors as described above relative to FIG. 12. This arrangement provides the benefit that the missile 70 may be readily constructed to a particular length between the nose 71 and tail 72. If desired, the missile 70 may be provided with a parachute 75 to slow and control the descent.

Referring to FIG. 19, the covers 74 may be blown off upon firing of the ammunition 40. This arrangement provides the benefit that the covers 74 can protect the munition 30, particularly a missile 70, and more particularly the payload comprising the ammunition 40, during flight and be blown off to not impair effect upon ignition of the ammunition 40.

Referring to FIG. 20, if desired, the missile 70, or stationary munition 30, may comprise plural stages. A first stage may be deployed responsive to a first ignition signal, a second stage may be later deployed responsive to a second ignition cell and so on. This arrangement provides the benefit that the operator can tailor the effect to the specific progress of the mission.

Figure 21:
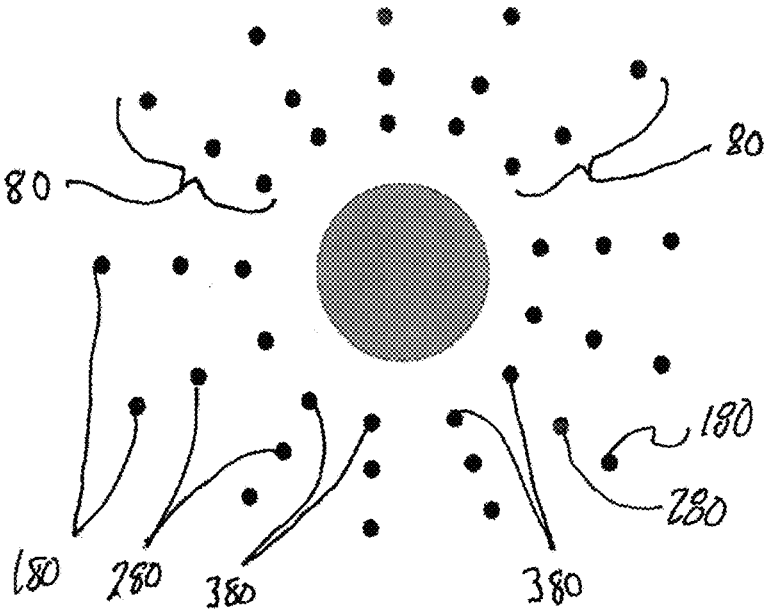
FIG. 21 is a schematic frontal view of an exemplary blast pattern from the present invention.

Referring to FIG. 21, a munition 30 may develop a radial blast pattern in a sequence of steps. A first phase 180 of ammunition 40 may be fired, followed by a second phase 280 of ammunition 40, followed by a third phase 380 of ammunition 40, etc. The phases 80 may use different ports 32 to accommodate the distinct and separate ammunition 40 fired from each port 32. Thus a first plurality of ports 32 (with respective cap 51 and barrel 50 assemblies) may be designated for the first phase 180, a second plurality of ports 32 (with respective cap 51 and barrel 50 assemblies) may be designated for the second phase 280, a third plurality of ports 32 (with respective cap 51 and barrel 50 assemblies) may be designated for the third phase 380, etc.

It can be seen that the nonfragmentary munition 30 of the present invention provides several advantages over the prior art. Energy is not expended rupturing the shell as occurs in the prior art, the blast pattern is more specular and less random than occurs in the prior art and times/sequential firing in several different vectors is possible.

If desired, the munition 30 of the present invention may be separately deployed in a payload delivery device as described in commonly assigned patent application Ser. No. 18/339,647 filed Jun. 22, 2023 to Echevarria et al, the disclosure of which is incorporated herein by reference. The munition 30 of the present invention may also be used for air to ground and air to air missions, with or without a missile 70 to direct the munition 30 towards a target.

All values disclosed herein are not strictly limited to the exact numerical values recited. Unless otherwise specified, each such dimension is intended to mean both the recited value and a functionally equivalent range surrounding that value. For example, a dimension disclosed as "40 mm" is intended to mean "about 40 mm." Every document cited herein, including any cross referenced or related patent or application, is hereby incorporated herein by reference in its entirety unless expressly excluded or otherwise limited. The citation of any document or commercially available component is not an admission that such document or component is prior art with respect to any invention disclosed or claimed herein or that alone, or in any combination with any other document or component, teaches, suggests or discloses any such invention. Further, to the extent that any meaning or definition of a term in this document conflicts with any meaning or definition of the same term in a document incorporated by reference, the meaning or definition assigned to that term in this document shall govern. All limits shown herein as defining a range may be used with any other limit defining a range of that same parameter. That is the upper limit of one range may be used with the lower limit of another range for the same parameter, and vice versa. As used herein, when two components are joined or connected the components may be interchangeably contiguously joined together or connected with an intervening element therebetween. A component joined to the distal end of another component may be juxtaposed with or joined at the distal end thereof. While particular embodiments of the present invention have been illustrated and described, it would be obvious to those skilled in the art that various other changes and modifications can be made without departing from the spirit and scope of the invention and that various embodiments described herein may be used in any combination or combinations. It is therefore intended the appended claims cover all such changes and modifications that are within the scope of this invention.

What is claimed is:

1. A missile for delivering a payload and defining a longitudinal axis, the missile comprising:

a nonfragmenation multi-directional munition having:

a hollow collar, the hollow collar having an inner surface and an outer surface opposed thereto and a first plurality of ports extending therebetween in a substantially radial direction;

a first plurality of ammunitions, wherein an ammunition is disposed in each port of the first plurality of ports and oriented outwardly from the longitudinal axis, wherein the first plurality of ammunitions comprises a first plurality of bullets, wherein a bullet is disposed in each port of the first plurality of ports and oriented away from the longitudinal axis;

an ignition source for expelling each ammunition of the first plurality of ammunitions outwardly from the collar wherein the bullets of the first plurality of bullets are fired in a predetermined sequence;

at least one flight control surface for controlling a trajectory of the missile during flight; and a controller for controlling the flight of the missile and the ignition source.

2. A missile according to claim 1 wherein the predetermined sequence is a spiral circumscribing the missile.

3. A missile according to claim 1 wherein the predetermined sequence is substantially longitudinally oriented.

4. A missile according to claim 1 wherein the predetermined sequence is substantially circumferentially oriented and comprises a plurality of circumferential rows.

5. A missile according to claim 1 wherein a second plurality of bullets comprises bullets fired in a direction having a longitudinally forward vector component and a third plurality of bullets having a longitudinally rearward vector component.

6. A missile according to claim 1 having manageable instructions, the instructions being revisable as the end of the trajectory is approached.

7. A missile for delivering a payload and defining a longitudinal axis, the missile comprising:

a nonfragmenation multi-directional munition having:

a hollow collar, the hollow collar having an inner surface and an outer surface opposed thereto, a first plurality of ports extending therebetween in a substantially radial direction, the ports being spaced apart in the longitudinal and circumferential directions, the collar having an aspect ratio from 1 to 10;

a first plurality of ammunitions, wherein an ammunition is disposed in each port of the first plurality of ports and oriented outwardly from the longitudinal axis;

an ignition source for expelling each ammunition of the first plurality of ammunitions outwardly from the collar;

at least one flight control surface for controlling a trajectory of the missile during flight; and a controller for controlling the flight of the missile and the ignition source, the controller having a first plurality of wires connected to the first plurality of ammunitions wherein each ammunition of the first plurality of ammunitions is connected to the controller by a dedicated wire within the first plurality of wires.

8. A missile according to claim 7 further comprising a body encasing the hollow collar, the body having frangible covers registered with the ports of the collar.

9. A missile according to claim 8 wherein the plurality of ammunitions comprises an explosive.

10. A missile according to claim 7 wherein the first plurality of ports comprises a second plurality of relatively larger ports and a third plurality of relatively smaller ports.

11. A missile according to claim 10 wherein at least some of the relatively larger ports are disposed longitudinally outboard of at least some of the relatively smaller ports.

12. A missile according to claim 7 wherein the first plurality of ports comprises ports having mutually different shapes, with a first shape of port being disposed in a first column and a second shape of port being disposed in a second column circumferentially spaced therefrom.

* * * * *